US005103516A

United States Patent [19]

Stevens

[11] Patent Number: 5,103,516

[45] Date of Patent: Apr. 14, 1992

[54] PILLOW-LIKE BODY SUPPORTS AND PROTECTORS AND SYSTEM OF SAME

[76] Inventor: Emeline Stevens, 229 E. 85th St., New York, N.Y. 10028

[21] Appl. No.: 351,460

[22] Filed: May 10, 1989

Related U.S. Application Data

[63] Continuation-in-part of Ser. No. 193,576, May 13, 1988, abandoned.

[51] Int. Cl.[5] ..... A47C 20/02

[52] U.S. Cl. ..... 5/640; 5/648

[58] Field of Search ..... 5/431, 436, 437, 443, 5/465

[56] References Cited

U.S. PATENT DOCUMENTS

| | | | |
|---|---|---|---|
| 682,871 | 9/1901 | Hogan et al. | 5/441 |
| 1,170,119 | 2/1916 | Sefton . | |
| 1,548,728 | 8/1925 | Milam . | |
| 2,478,497 | 8/1949 | Morrison . | |
| 2,795,802 | 6/1957 | Myers | 5/436 |
| 2,933,738 | 4/1960 | Whelan | 5/431 |
| 3,158,878 | 12/1964 | Pernell | 5/431 |
| 3,256,879 | 6/1966 | Hipps . | |
| 3,428,974 | 2/1969 | Stuart . | |
| 3,451,071 | 6/1969 | Whiteley . | |
| 3,626,526 | 6/1969 | Viel . | |
| 4,054,960 | 10/1977 | Petit et al. . | |
| 4,210,317 | 7/1980 | Spann et al. | 5/431 |
| 4,270,235 | 6/1981 | Gutmann . | |
| 4,278,079 | 7/1981 | Simnoni et al. | 5/443 |
| 4,290,155 | 9/1981 | Hanson . | |
| 4,405,129 | 9/1983 | Stuckey | 5/441 |
| 4,459,714 | 7/1984 | Lin | 5/441 |
| 4,584,730 | 4/1986 | Rajan . | |
| 4,596,384 | 6/1986 | Blosser . | |
| 4,736,477 | 4/1988 | Moore | 5/431 |
| 4,779,296 | 10/1988 | Bond | 5/443 |
| 4,799,275 | 1/1989 | Sprague, Jr. | 5/431 |

FOREIGN PATENT DOCUMENTS

| | | | |
|---|---|---|---|
| 1239709 | 7/1988 | Canada | 5/431 |
| 127058 | 1/1950 | Sweden | 5/437 |

*Primary Examiner*—Renee S. Luebke
*Assistant Examiner*—Mike Milano
*Attorney, Agent, or Firm*—Levisohn, Lerner & Berger

[57] ABSTRACT

A system of pressure point pillow-like devices is disclosed. The system includes a relatively large pillow-like device of a size and configuration to be disposed beneath the person when lying down and having an opening therethrough in the area of the person's coccyx with a slot extending therefrom to provide for air circulation. Knee rests extend out from each side of the large pillow-like device to accommodate the person when on their side. A thigh rest is of a size to cooperate with and from an extension of the relatively large pillow-like device to accommodate the person's thighs. Scapula-elbow-arm rests are also provided for that area of the person's anatomy and each includes first and second pillow-like portions connected along a relatively thin line forming an air channel. Flaps are provided for each scapula-elbow-arm rest to connect one pillow portion to another. Elbow and heel protectors are also included in the system. All items of the system are formed from relatively soft and mild cotton polyester-like materials which are washable with the relatively large pillow device, thigh rest and scapula-elbow-arm rest being filled to a desired thickness with polyurethane. Almost all edges and corners are rounded off.

6 Claims, 2 Drawing Sheets

FIG. 3
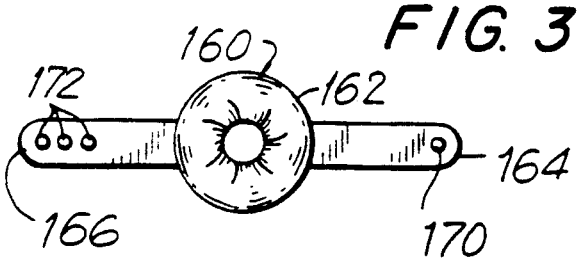
FIG. 4
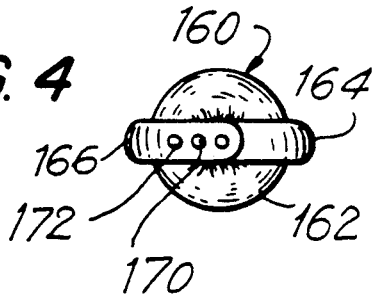
FIG. 5
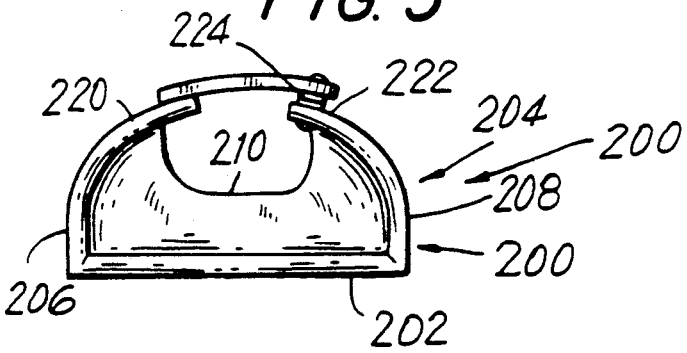
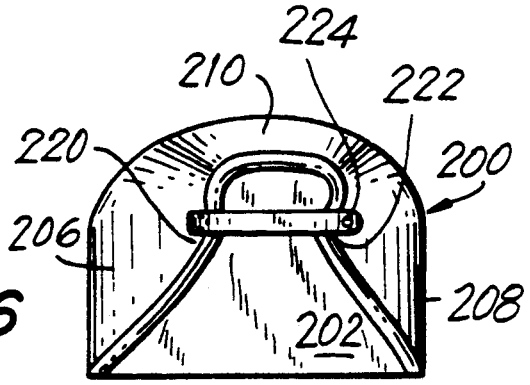
FIG. 6

PILLOW-LIKE BODY SUPPORTS AND PROTECTORS AND SYSTEM OF SAME

This application is a continuation-in-part of application Ser. No. 07/193,576 filed May 13, 1988 and now abandoned.

BACKGROUND OF THE INVENTION—FIELD OF APPLICATION

This invention relates to body support and protection devices; and, more particularly, to such devices used to support and protect areas and parts of the body of a person confined for prolonged periods to a bed, wheelchair or the like.

BACKGROUND OF THE INVENTION—DESCRIPTION OF THE PRIOR ART

Prolonged confinement to a bed or wheelchair can, and sometimes does, result in discomfort to the person so confined. Quite often such confinement also results in complications including bed sores or other ulcerations. The discomfort, sores and ulcerations are generated by the continued contact between particular areas and points of the body with the support such as a mattress, and its sheets or other protective coverings. Lying in a particular position for a prolonged period produces prolonged external pressure on body tissues covering rigid or bony body parts. This compromises the blood supply to these areas which, after a sustained period results in local necrosis and the formation of sores constituting localized areas of dead tissue over bony body protuberances. Such conditions are aggravated when the patient is thin or has become thin due to prolonged periods of being an invalid and immobile. The discomfort, sores, and ulcerations are further exacerbated when the sheets and other bed coverings bunch up or wrinkle, which can occur with each movement of the person.

Quite often the regular turning of the person to a different position by attendants or hospital staff merely increases the number of body parts afflicted with the discomfort, sores, and ulcers.

Mattress-type body supports of configurations to provide support for particular body areas are known. However, those of the type shown and described in U.S. Pat. No. 1,548,728 granted on Aug. 4, 1925 to W. D. Milan for Mattress and in U.S. Pat. No. 4,054,960 granted on Oct. 25, 1977 to John E. Petil, et al for *Inflatable Body Support Cushion Particularly To Support A Woman During Pregnancy* are constructed and configured only to accommodate a person lying in a facedown position, and with a peculiar body configuration (such as being pregnant), and as such are not suitable for use to prevent discomfort, sores and ulcers for a person who must lie or sit for prolonged periods of time. Body part supports such as shown and described in U.S. Pat. No. 1,170,119 granted on Feb. 1, 1916 to F. W. Sefton for *Chiropractic Adjusting Table,* and in U.S. Pat. No. 4,596,384 granted on June 24, 1986 to E. E. Blosser for *Spinal Adjustment Table* are also peculiarly adapted to support persons lying in a facedown position and as such are unsuitable for accommodating persons who are confined to lie or sit on their backs, sides or other similar positions.

Still other specialized body supports are shown and described in U.S. Pat. No. 4,584,730 on Apr. 29, 1986 to E. Rajan for *Device For Stabilizing The Pelvis Of A Patient Lying On His Side.* This device, however, is only usable for pelvis stabilization and is not suitable or applicable to facilitate reduction in bed sores and ulcerations for persons who are confined to beds or wheelchairs for prolonged periods but who are permitted to assume a number of positions while doing so.

Other mattress type body supports are shown, for example, in U.S. Pat. No. 3,428,974 granted on Feb. 25, 1969 to J. C. Stuart for *Compartmented Air Mattress,* in U.S. Pat. No. 4,290,155 granted on Sept. 22, 1981 to P. B. Hanson for *Articulated Bed,* in U.S. Pat. No. 3,626,526 granted on Dec. 14, 1971 to E. P. R. Viel for Mattresses and in U.S. Pat. No. 3,451,071 granted on June 24, 1969 to J. G. Whiteley for *Means For Removing Pressure From Pressure Sores.* The Stuart type mattress (U.S. Pat. No. 3,428,974) however, is merely made up of a number of inflatable sections of identical configuration and which are individually inflated to different pressures if desired and does not accommodate different body parts so as to minimize or prevent sores and ulcers. The Hanson type mattress (U.S. Pat. No. 4,290,155) is constructed with cut-outs to accommodate a couple in various positions for sexual intercourse and is completely unsuited for relieving pressure on body parts of persons confined to bed for prolonged periods. A mattress of the Viel type (U.S. Pat. No. 3,626,526) requires a highly complex construction which, when completed, is best suited to accommodate the body configuration of a single person and is thus costly and lacks versatility. While a mattress of the Whiteley type (U.S. Pat. No. 3,451,071) is constructed for persons with trochanteric pressure sores on their hips and neither teaches nor shows constructions suitable and adaptable to other body parts. In addition, the Whiteley construction requires utilizing a large number of abutting ancillary pads in conjunction with the decubitus pad and thus increases the relative cost of the device while adding to the number of pads that must be stored and utilized.

Available and known constructions, such as those described above, moreover, are of mattress or bed size and are peculiarly configured to support a person in the prone position.

Known pressure relieving pads are shown, for example, in U.S. Pat. No. 2,933,738 granted on Apr. 26, 1960 to K. J. Whelan for *Pressure-Relieving Pad.* Such pad construction requires the use of holes to accommodate particular body parts of the user and in doing so, may present juncture lines about such holes that may add to the discomfort of the user and may, in and of themselves, create sores and ulcerations. In addition, possible close contact between other surfaces of such pads and the body parts of the user may prevent air circulation and add further to user discomfort and to possible sores and ulcerations.

Devices, such as that shown in U.S. Pat. No. 4,270,235 granted on June 2, 1981 to G. L. Gutmann for *Arm Support Pillow,* on the other hand, are configured to support only an arm of a convalescing patient. But do so with relatively stiff and unyielding material and in only one particular disposition. Alternatively, devices such as shown in U.S. Pat. No. 3,256,879 granted on June 21, 1966 to H. E. Hipps for *Invalid Heel Pad,* in U.S. Pat. No. 2,478,497 granted on Aug. 9, 1949 to M. B. Morrison for *Rest* and in U.S. Pat. No. 4,278,079 granted on July 14, 1981 to Orit Simboni, et al for *Negative Heel Protector Cushion* are intended to support heels and feet of patients but again do so with devices made of various kinds of foam rubber, leather and Kapock which cradle the limb under conditions which do not facilitate air circulation about the body part and disposition of the body part in other then a prone body position.

SUMMARY OF THE INVENTION

It is, therefore, an object of this invention to provide new and improved pillow-like body part supports.

It is another object of this invention to provide new and improved pillow-like body part protectors.

It is yet another object of this invention to provide a new and improved system of supporting and protecting body parts.

It is still another object of this invention to provide a new and improved system of pillow-like body part supports and protectors.

It is yet still another object of this invention to provide a new and improved system of pillow-like supports for supporting body parts while in either a prone or sitting position and to protect such body parts from sores and ulcers while so disposed.

It is a further object of this invention to provide a new and improved pillow-like support protector for the torso of a person.

It is still a further object of this invention to provide a new and improved pillow-like support and protector for the arms of a person.

It is yet a further object of this invention to provide new and improved pillow-like supports and protectors for the elbows of a person.

It is yet still a further object of this invention to provide new and improved pillow-like supports and protectors for the heels of a person.

It is yet still a further object of this invention to provide new and improved pillow-like supports and protectors for the torso, arms, elbows and heels of a person that coordinates and acts as a system to support and protect such body parts.

This invention involves the support and protection of parts of the human body particularly when confined to a bed or wheelchair for prolonged periods of time to minimize if not eliminate bed sores and ulcerations that ensue from prolonged bed and wheelchair stays. It contemplates providing pillow-like supports and protectors for the body parts (namely torso, arms, elbows, heels) which provide a soft cushion support for same while permitting the flow of air about the body part to thus minimize or eliminate bed sores and ulcers.

Other objects, features, and advantages of the invention in its details of construction and arrangement of parts will be seen from the above, from the following description of the preferred embodiments when considered with the drawing and from the appended claims.

BRIEF DESCRIPTION OF THE DRAWING

In the drawing:

FIG. 3 is a plan view of a pillow-like support and protector for the elbows of a person showing same in its straps-open position;

FIG. 4 is a plan view of the pillow-like support and protector of FIG. 3, but showing same with its straps in their strap-closed position as though disposed about a person's elbow;

FIG. 5 is an elevation view of pillow-like support and protector for the heels of a person; and FIG. 6 is a plan view of the pillow-like support and protector of FIG. 5.

DESCRIPTION OF THE PREFERRED EMBODIMENT

Figure 1:
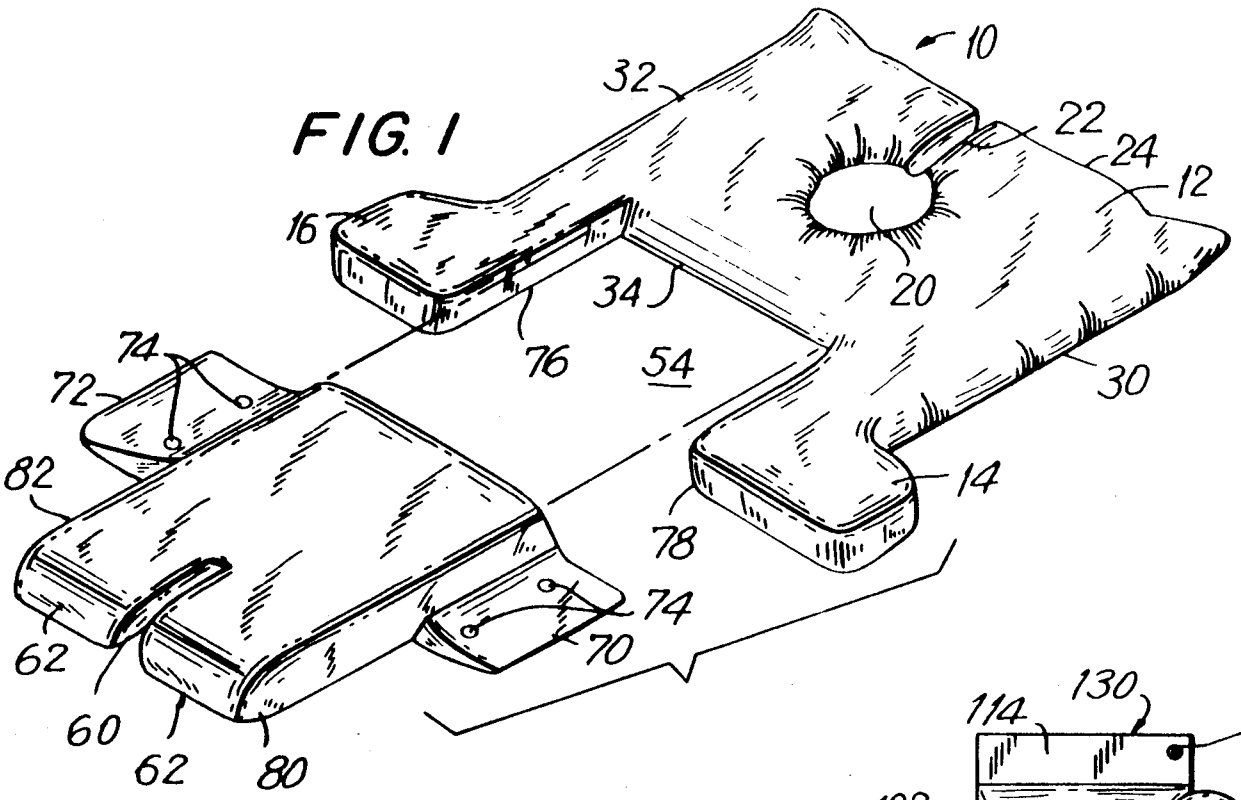
FIG. 1 is a perspective view of a pillow-like support and protector, embodying the instant invention, for the torso of a person and showing a thigh rest for use, in conjunction therewith.

With reference to FIG. 1, there is generally shown at 10 a pillow-like support and protector device of a size and configuration for protecting and supporting the torso of a person, particularly when they are lying in a horizontal recumbent position, a dorsal recumbent position or fowler's position. Pillow 10, as will be hereinafter explained in greater detail, is constructed and configured to receive those parts of a persons body which would otherwise come in direct contact with the bed or bed linen upon which they are lying and includes a main body section 12 including a pair of somewhat "L" shaped knee rests 14, 16. Body section 12 is fabricated from relatively soft cotton material stuffed with polyurethane which is a safe substance.

A spine guard opening 20 is formed in body section 12 as a substantially circular opening with a key hole slot 22 extending therefrom to an upper edge 24 of body section 12. If desired additional slots may be formed at upper edge 24 to facilitate air circulation for a person when using pillow 10.

Body section 12 also includes side edges 30, 32, and a lower edge 34 all of which, along with upper edge 24, are rounded off for comfort and safety. Similarly, opening 20 is defined by a circumferential edge 36 which is also rounded off for comfort and safety.

A thigh rest pillow 50 is provided for cooperation with pillow 10 and includes a body portion 52 of a size and configuration to fit within an opening 54 therefore formed on body section 12 between knee rests 14, 16. Pillow 50 is fabricated from relatively soft and mild material such as cotton or cotton and polyester and is stuffed to a desired thickness with polyurethane. A slot 60 is formed to extend from a lower edge 62 of thigh rest 50 into body portion 52. A pair of flaps 70, 72 extend out from body portion 52 with each such flap 70, 72 including one or more snap fasteners 74 disposed to cooperate with snap fasteners suitably positioned on under surfaces 76, 78 of knee rests 14, 16 proximate opening 54. As such thigh rest pillow device 50 can be disposed so that at least a portion of its body 52 lies within opening 54 and so as to be attached to body section 10 by way of snap fasteners 74. Other suitable and appropriate fastening means may be provided to connect thigh rest 50 to body section 10. Edges 80, 82 and 60 and 62 of thigh rest 50 are rounded off to provide for comfort and safety.

Pillows 10 and 50 are of a size and configuration to receive a person lying in a horizontal recumbent position, a dorsal recumbent position or in fowlers position. For example, body section 12 may be 29 inches between edge 30 and 32, 18 inches between upper edge 24 and lower edge 34, and 28 inches between upper edge 24 and the ends of knee rests 14, 16. Thigh rest 50, on the other hand, may, for example, be 15 inches long with flaps 70, 72 each 4 inches wide and 7½ inches long. It should generally accommodate the shape of the thigh from below the head of the femur to above the patella.

Both pillow 10 and thigh rest 50 may be otherwise sized and configured to accommodate adults or children of various sizes.

Pillows 10 and 50 are especially designed as "pressure point pillows" to relieve the pressure from the spine, knees, hips and other torso parts of a person confined to a bed and who is lying upon pillows 10 and/or 50. They are extremely useful for patients recovering from operations, patients with tender spines, knees, hip bones and other body parts. Patients with cardiac and asthma problems, patients sitting in wheelchairs, those with occupational diseases and those prone to bed sores will realize great relief when utilizing pillows 10 and 50.

Spine guard opening 20 and slot 22 and surrounding portions of body section 12 properly support the patients spinal area and provide air circulation thereto. They serve to relieve pressure from the spine and coccyx and induce blood circulation by way of the openings and slots to ventilate the spine thus preventing sores and/or healing sore spines.

Restless patients who are not capable of adjusting pillows will not come in contact with sharp edges when utilizing pillows 10 and/or 50 since such have been carefully eliminated.

Should the person turn on one side or the other their hip bones will be received by the relatively soft spongy pillow. In addition, knee rests 14 or 16 will support and protect the knee areas of a person so lying on their side on pillow 10 and 50. The thigh rest 50 and knee rests 14, 16 serve to put knee joints at ease and reduce or prevent muscle contact. When thigh rest 50 is extended to the lower legs it raises the heels and ensures blood circulation. It provides for good body alignment (body evenly balanced).

Thigh rest 50 is also recommended for persons lying in fowlers position, horizontal recumbent position and dorsal recumbent position. Slightly bent knees supported by thigh rest 50 will relax muscles of the abdomen. Persons lying in dorsal recumbent position need be protected against plantar flexion (foot drop) which can be accomplished using thigh rest 50.

A pair of scap arm rest pillows 100, 102 (FIG. 2) are provided for supporting and protecting the scapulas, shoulders, arms and elbows of persons. Pillows 100, 102 are fabricated from relatively mild cotton material (i.e. cotton and polyester) are stuffed with polyurethane to an appropriate thickness.

Figure 2:
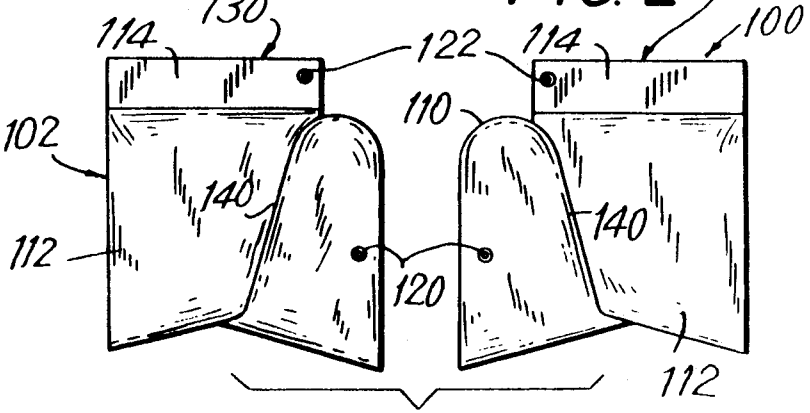
FIG. 2 is a plan view of a pair of pillow-like supports and protectors for the scapula-arm areas of the human body.

Each scap arm rest 100, 102 includes a first pillow section 110, a second pillow section 112, and a flap 114. Pillow section 110, 112 are filled with polyurethane while flaps 114 are merely flat strips of material. A snap fastener 120 is attached to each pillow section 110 as shown in FIG. 2 while the cooperating portion 122 for snap fastener 120 is attached to an underside 130 of flaps 114.

Pillow sections 110, 112 are sized to accommodate adults and children of various sizes and proportions and may for example be sized so that sections 110 are approximately 11 inches long and 6 inches wide, midway from top to bottom; while sections 112 may be 9–10 inches long and about 7 inches wide midway between its length. An air channel 140 is provided between sections 110, 112 as by sewing the material thereof together with no stuffing along the line of air channel 140.

When snapped together and disposed about a person's arm scap arm rests 100, 102 will elevate the arms and relieve the scapulas of pressure. They will ease the person's shoulders, induce blood circulation, prevent elbows from coming in contact with bed linens and enable sore elbows to more readily heal.

A person's arms raised for blood circulation purposes may be supported by scap arm rests 100, 102. The arms may be raised for 5 minutes and thereafter repeated. Veins may thus be opened up to release trapped fluids into joints of the fingers that otherwise would cause swellings and pain.

Scap arm rests 100, 102 are reversible and of equal stiffness.

An elbow rest 160 (FIGS. 3 and 4) includes a doughnut shaped body portion 162 with a pair of straps 164, 166 extending therefrom. Elbow rests 160 are fabricated from relatively soft and mild fabric such as cotton and polyester and are thickly lined with cotton. They are sized to accommodate adults and children and may for example be 18 inches in circumference The edges of elbow rest 160 are rounded off as by the use of darts or similar technique.

Straps 164, 166 respectively carry cooperating halves of snap type fasteners 170, 172 which cooperate when fastened to locate an elbow rest about a persons elbow. Straps 164, 166 are selected to be long enough to permit the arms to bend.

Elbow rests 160 may be used as a substitute for scap arm rests 100, 102 (FIG. 2) by persons with less problems with their upper limbs and for restless patients. Elbow rests 160 may also be worn out of bed by persons sitting in wheelchairs and who might have delicate elbows. They relieve the elbows of pressure and keep them comfortable.

A heel rest pillow-like device 200 is shown in FIGS. 5 and 6. Each includes a bottom layer 202 and an upwardly extending layer 204 having side walls 206, 208 and a back wall 210. Side walls 206, 208 terminate at upper corners 220, 222 with a strap extending from corner 220 and being long enough to extend over corner 222. A snap type fastener 224 has one of its cooperating ends carried on the underside of 220 and the other of its ends positioned proximate corner 222.

Heel rests 200 are of a size and configuration to be worn about the heels of a person and may be accordingly sized for adults and children. They are fabricated from relatively soft and mild fabric such as cotton and polyester and are thickly lined with cotton. Bottoms 202 are somewhat squared off with curved corners.

Heel rests 200 are worn to protect heels and ankles and prevent them from coming into contact with hard substances and becoming sore. The configuration is such as to provide ventilation to these body parts.

From the above description it will thus be seen that there have been provided pillow-like body support and protection devices usable individually and in various combinations to protect various parts of a person's body from sores and ulcerations and to protect delicate body parts which may otherwise be sore to facilitate healing thereof. The pillow-like devices are relatively inexpensive in construction and use and are fabricated from materials that permit ready washing thereof.

It is understood that although I have shown the preferred embodiments of my inventions that various modifications may be made in the details thereof without departing from the spirit as comprehended by the following claims.

What is claimed is:

1. A pillow-like body protection and support device; comprising:

(a) a body section of predetermined side-to-side and end-to-end dimensions and terminating at said ends and sides in edges;

(b) said edges being formed to be rounded off;

(c) an opening extending through said body section and defined by edges which are rounded off;

(d) a key hole like slot extending from said opening to a first of said ends; and (e) said body section further including substantially "L" shaped rest portions extending from the other of said ends outwardly past said side edges;

(f) said body section being fabricated from relatively soft material and being stuffed with a predetermined substance to provide a pillow-like device, and being of a size, configuration and proportions to accommodate a person lying thereon with the coccyx area of their spine disposed over said opening and the spine extending in the direction of said slot.

2. The pillow-like protector and support device of claim 1, wherein said relatively soft material is cotton and said predetermined substance is polyurethane.

3. The pillow-like protector and support device of claim 2, wherein said rest portions are of a size and configuration and are disposed to receive the knees of a person lying upon their side on the pillow-like device.

4. The pillow-like protector and support device of claim 3 further including a thigh rest portion of the same materials and stuffed with the same substance as said device; a space between said rest portions and said thigh rest being of a size and configuration so that at least a portion of said thigh rest fits within said space.

5. The pillow-like protector and support device of claim 4, including flap means carried by said thigh rest portion to extend therefrom towards and for cooperation with said rest portions and fastener means for securing said flaps to said rest portions.

6. The pillow-like protector and support device of claim 5, including a slot extending from a lower edge wall of said thigh rest into said thigh rest; said thigh rest when disposed for coaction with said body section cooperating therewith to support a person in a lying down position such that bed sores and ulcerations are minimized.

* * * * *